US009347240B2

(12) United States Patent
Herman

(10) Patent No.: US 9,347,240 B2
(45) Date of Patent: May 24, 2016

(54) POCKET DOOR PULL DEVICES

(71) Applicant: Kent Herman, Bend, OR (US)

(72) Inventor: Kent Herman, Bend, OR (US)

( * ) Notice: Subject to any disclaimer, the term of this patent is extended or adjusted under 35 U.S.C. 154(b) by 57 days.

(21) Appl. No.: 14/024,177

(22) Filed: Sep. 11, 2013

(65) Prior Publication Data

US 2015/0067987 A1 Mar. 12, 2015

(51) Int. Cl.
*E05B 1/00* (2006.01)
*E05B 65/08* (2006.01)

(52) U.S. Cl.
CPC ..... *E05B 1/0015* (2013.01); *E05B 65/08* (2013.01); *Y10T 16/458* (2015.01)

(58) Field of Classification Search
CPC ..... E05B 1/0053; E05B 1/06; E05B 1/0015; E06B 3/4654
USPC ..... 16/110.1, 412, 413, 415, 416; 49/372
See application file for complete search history.

(56) References Cited

U.S. PATENT DOCUMENTS

| | | | | | |
|---|---|---|---|---|---|
| 174,626 | A * | 3/1876 | Gorman | 16/412 | |
| 414,625 | A * | 11/1889 | Andross | A47B 95/02 16/416 | |
| 2,616,122 | A * | 11/1952 | Curtiss, Jr. | 16/412 | |
| 3,514,904 | A * | 6/1970 | Riegelman | 16/412 | |
| 3,676,895 | A * | 7/1972 | Stewart | 16/412 | |
| 5,740,587 | A * | 4/1998 | Onai et al. | 16/412 | |
| 5,890,261 | A * | 4/1999 | Mantarakis | 16/413 | |
| 6,189,183 | B1 * | 2/2001 | Hartselle, III | 16/412 | |
| 6,938,375 | B2 | 9/2005 | Duncan et al. | | |
| D533,046 | S | 12/2006 | Donald | | |
| 2005/0034271 | A1 * | 2/2005 | Denys | 16/110.1 | |

OTHER PUBLICATIONS http://www.trimcobbw.com/door-hardware/products/door-pulls-and-grips /069FP.asp—last access on Sep. 9, 2013 at 12:00PM.
http://www.hangingdoorhardware.com/pocketdoors/ada_pocket_door_hardware.html—last access on Sep. 9, 2013 at 12:00PM.
http://www.accuratelockandhardware.com/catalog/07_pocket.pdf—last access on Sep. 9, 2013 at 12:00PM.

* cited by examiner

*Primary Examiner* — Jeffrey O Brien
(74) *Attorney, Agent, or Firm* — Leber Patent Law P.C.

(57) ABSTRACT

The invention relates to pocket door hardware. Devices are disclosed that include a plate configured to fit over a surface pull of a pocket door, and members protruding from the plate away from the broad plane of the door.

9 Claims, 6 Drawing Sheets

POCKET DOOR PULL DEVICES

BACKGROUND

Some sliding doors are designed, when closed, to recess completely into a frame that is installed within a wall between two opposing wall surfaces. Such doors are commonly referred to as "pocket" doors. Pocket doors provide the functionality of a hinge-mounted door with the additional advantage of space-savings. They have become increasingly popular, for example in small homes and in offices where square-footage is expensive.

Referring to FIG. 1, a pocket door 5 is shown with an example of prior art hardware 20 that allows the user to manipulate the door, e.g. open, close, lock and unlock. Pocket doors 5 feature two broad surfaces 10 and an end surface 12. When the pocket door is in the open position, it is typically fully recessed in a frame contained in a wall (not shown). Pocket door hardware 20 can have a recessed area 30. The recessed area 30 allows easier manipulation of the door 5, e.g. as when opening or closing the door. Some versions of the hardware 20 feature a locking mechanism 35. Mounting screws 40 secure the door hardware 20 to the door 5.

Doors with this type of hardware may in some cases be difficult to open from a fully closed, recessed position, particularly if the user's hands are full or the user has difficulty grasping objects.

SUMMARY

Generally, the present disclosure relates to pocket door pull devices and methods of using such devices. These devices allow adaptation of existing pocket door hardware to provide exposed gripping surfaces to assist a user with opening the door when the pocket door is in a closed position and closing it when in an open position. In preferred implementations the devices can be installed using basic tools (e.g., a screwdriver) without the need for significant (or in most cases, any) modification of the door or existing hardware.

In one aspect, the invention features a device comprising a plate configured to fit over a surface pull of a pocket door, and members protruding from the plate away from the broad plane of the door.

Some implementations can include one or more of the following features.

The device may have an opening, which in some cases is dimensioned to allow access to an underlying recessed area. Furthermore, the opening may be dimensioned to allow use of a locking mechanism.

In some cases, the members may be generally perpendicular to the plate, and thus to the broad surface of the door when the device is in use. The members preferably have sufficient surface area to allow a user to apply a force to open or close the door. In some implementations, the members protrude from the surface of the door at least 0.2 inch (5 mm). The members may be positioned on opposite edges of the plate. The members may be configured such that, when the device is in use, at least one of the members extends generally parallel to the long axis of the door.

The plate may in some cases include mounting holes which are configured so that, when the plate is positioned over the surface pull, the mounting holes align with corresponding mounting holes of the surface pull. In some cases, the mounting holes may be elongated.

In another aspect, the invention features a device comprising pocket door hardware having a body, and a pair of members protruding from the body, such that when the pocket door hardware is mounted on a door the members extend away from a broad surface of the door.

Implementations of this aspect of the invention may in some cases include any one or more of the features discussed above.

The invention also features a method of opening a pocket door by applying a force to a member extending away from the broad plane of the door, wherein the member protrudes from a plate that is attached to the pocket door over a surface pull.

DETAILED DESCRIPTION

The present disclosure relates generally to door pull devices for pocket doors that are configured to allow a user to more easily open the door from a closed position or close the door when it is in a open position. The devices prevent the door from closing fully, while also providing an exposed gripping surface, or handle, that the user can easily grasp. Preferred devices can be used with existing door hardware without modification or carpentry of the door or existing door hardware.

Figure 1:
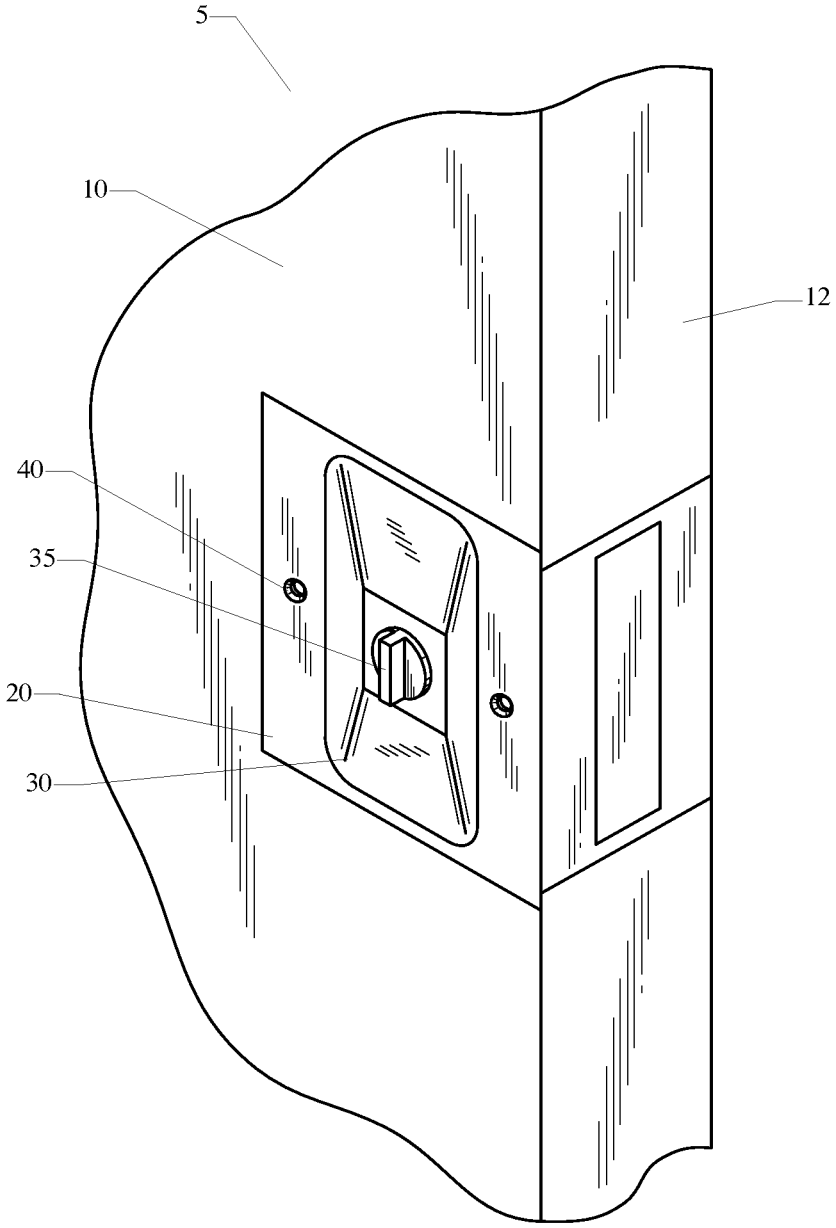
FIG. 1 PRIOR ART
FIG. 1 is a perspective view of prior art pocket door hardware.
Figure 2:
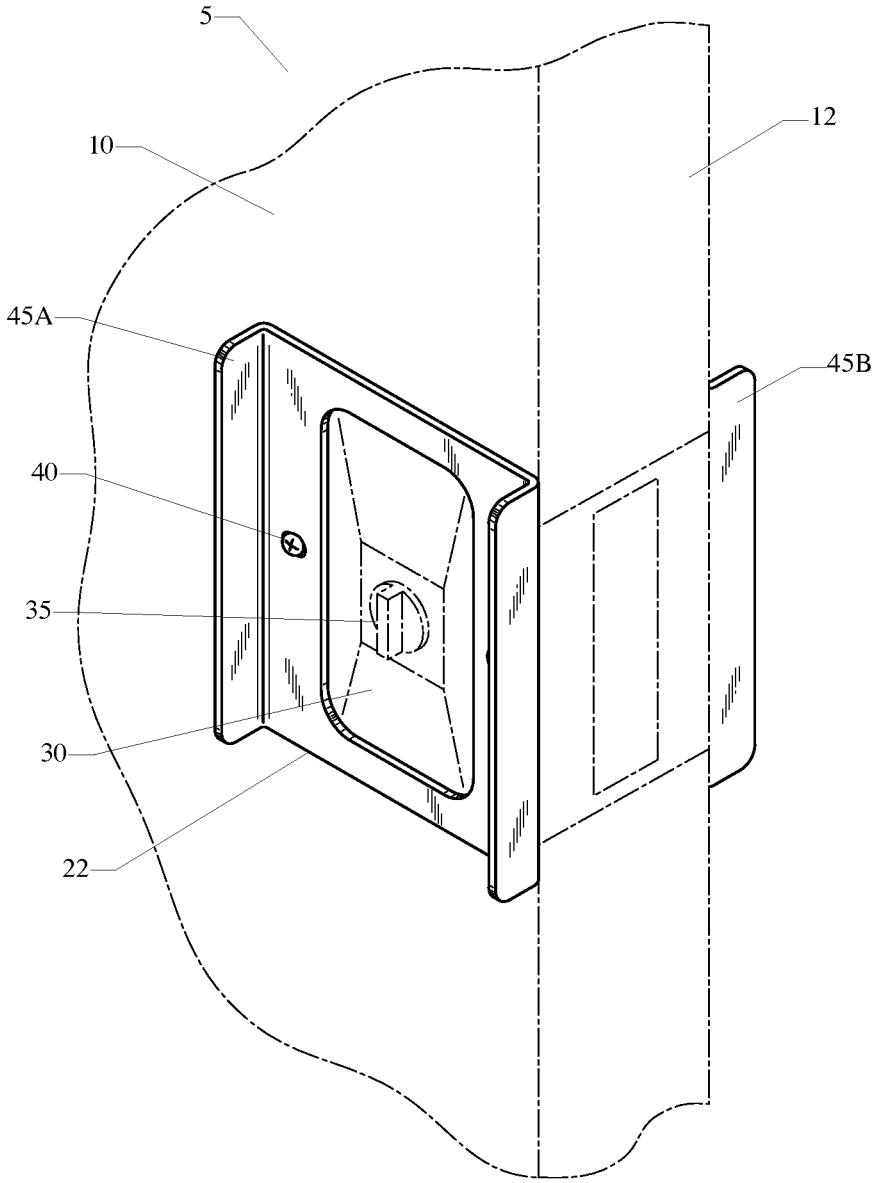
FIG. 2 is a perspective view of a pocket door pull device according to one embodiment of the invention installed on a door, over the hardware shown in FIG. 1 (which is shown in phantom lines in FIG. 2).

Referring to FIG. 2, a pocket door pull device 22 is shown installed over the existing door hardware shown in FIG. 1, utilizing the existing mounting holes 40.

Figure 3:
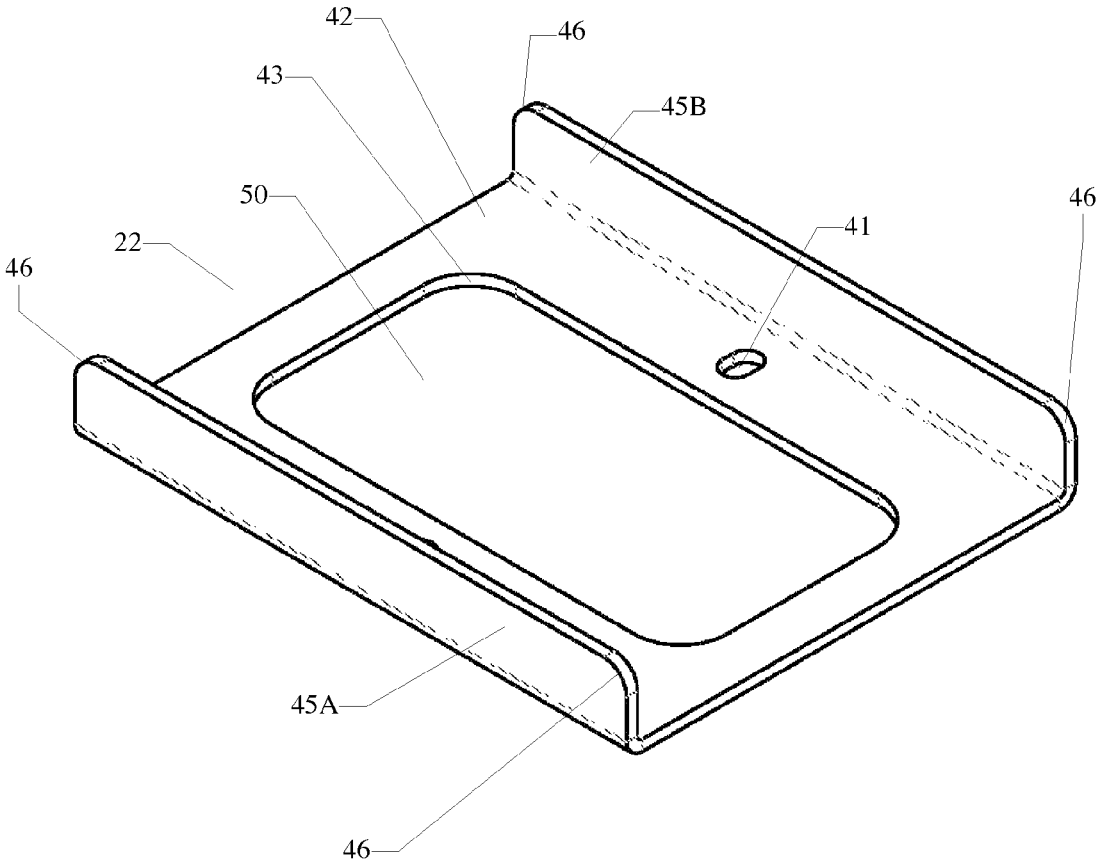
FIG. 3 is a perspective view of the device.
Figure 4:
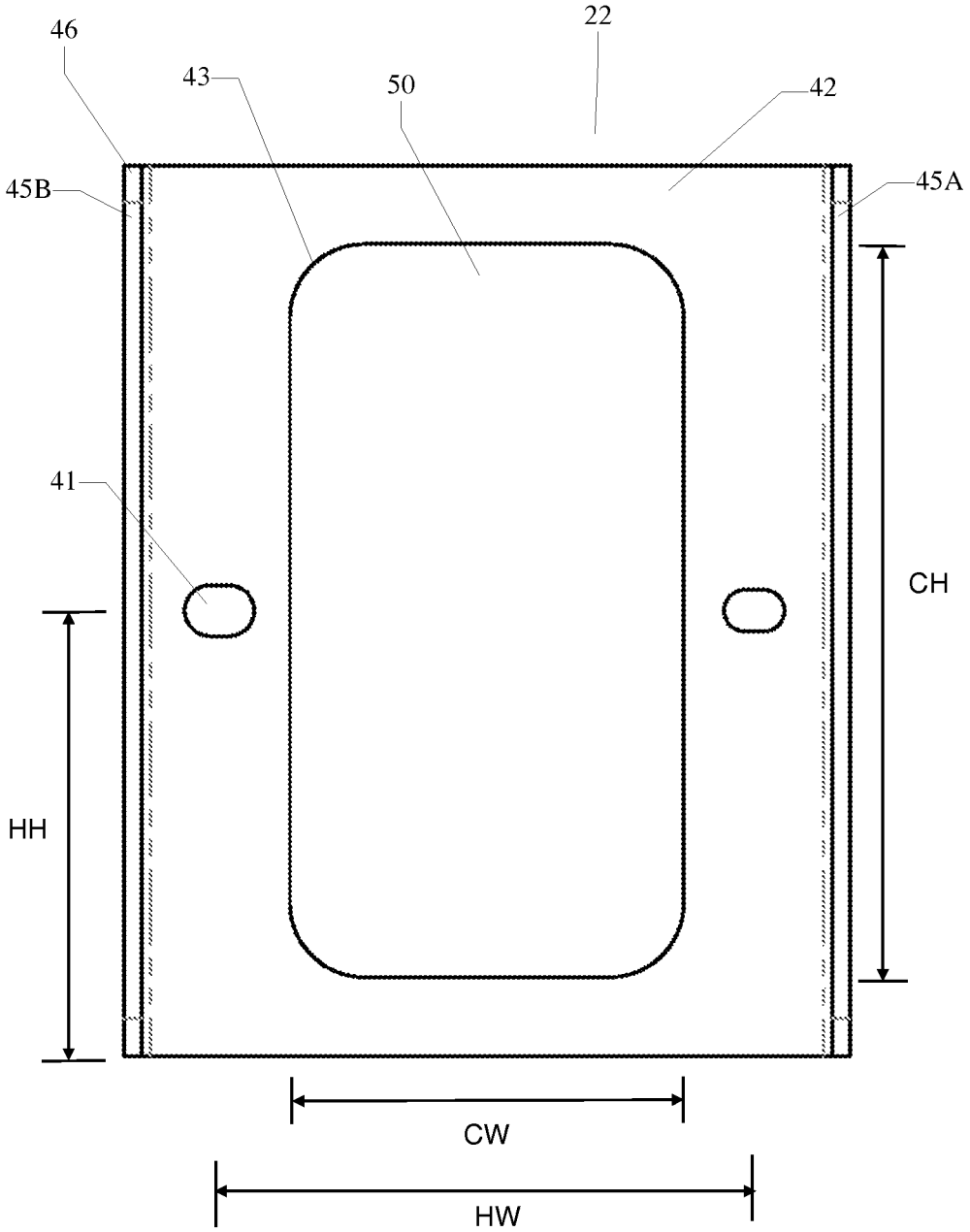
FIG. 4 is a front planar view of the device.
Figure 5:
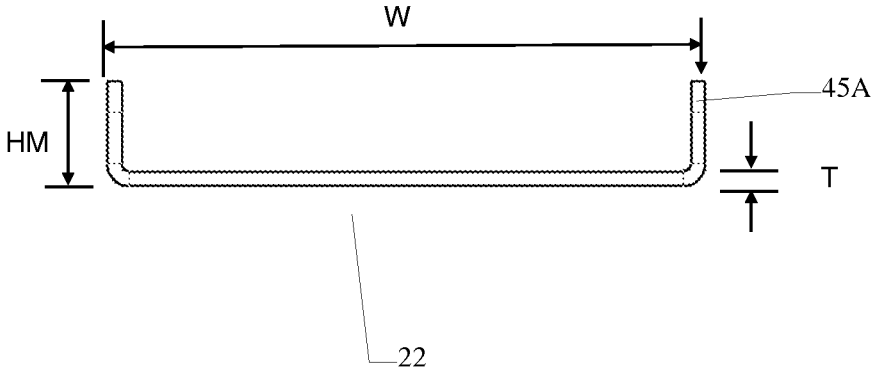
FIG. 5 is an end view of the device.
Figure 6:
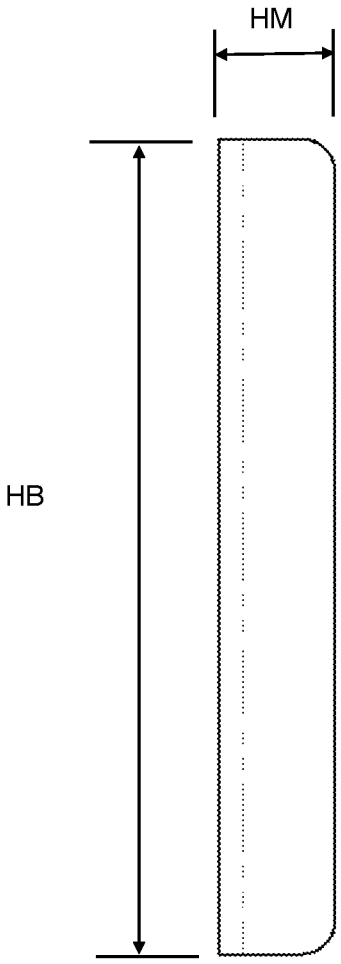
FIG. 6 is a side view of the device.

Referring to FIGS. 3 and 4, the device 22 features a body 42 and two members 45A/45B extending outwardly on opposing sides of the body 42. In use, the member 45A, which is spaced from the edge of the door engages the door frame and prevents the door from being completely recessed in the wall. The member 45B, the edge of which is preferably substantially aligned with the edge of the door, provides an exposed gripping surface or handle that can be grasped by the user to open the door. Referring to FIGS. 5 and 6, the members 45A/45B are substantially perpendicular to the body 42 of the device to provide a good angle of contact with the user's fingers. In the embodiment shown, the members extend the full length of the device. Referring to FIG. 3, edges 46 of members 45A/45B are radiused to prevent unwanted snagging or damage.

Ideally, a device 22 will be installed on each side of the door 5, on surfaces 10. This configuration allows the user to easily engage members 45B from either side. The handles allow the user to more easily interact with the door in either the opening or closing directions.

Referring again to FIGS. 3 and 4, two mounting holes 41 are positioned substantially near the middle of the device with respect to the long axis. Placement of the mounting holes 41 allows the user to utilize the mounting holes in the hardware 40. Thus, it is not necessary for the user to drill additional holes when installing the device 22, and the device can easily be mounted over the existing hardware, allowing continued use of the existing hardware. The mounting holes 41 are enlarged laterally to allow for accommodation of varying placement of hardware mounting holes (FIG. 1).

In preferred embodiments the body 42 defines a central cut-out section 50 that approximately aligns with the central recessed portion 30 of the existing door hardware. The central cut-out 50 allows the user to access locking mechanisms 35 commonly found on pocket door hardware, e.g. as shown in FIG. 1. The inner edges 43 (FIGS. 3 and 4) of the body defined by the cut-out 50 are radiused to allow for better alignment with the central recessed portion 30.

Referring to FIGS. 4-6, in some implementations the device 5 is about 2 to 3 inches wide (W) and about 2 to 4 inches in length (HB). The members 45A and 45B protrude from the device 22 a distance sufficient to allow the member 45A to act as a stop, and the member 45B to be easily grasped, for example, at least 0.2 inches (5 mm), e.g., from about 0.2 to 1.0 inches (HM). For aesthetic reasons and ease of manufacturing and installation, the members are generally the same height. The device 22 is of a sufficient thickness to have a desired degree of stiffness. The wall thickness (T) of the device will depend on the physical characteristics of the material used, but is generally from about 0.01 to 0.10 inches. The cut-out 50 is dimensioned to expose the underlying latch mechanism, and may in some cases be about 1 to 1.5 inches wide (CW) and about 2 to 3 inches high (CH). The mounting holes 41 may in some cases be located at the mid point of the long axis of the device, i.e., midway between the top and bottom edges of the device (HH). The center of the mounting holes 41 can be, for example, from about 1.5 to 2 inches apart (HW).

Preferably, the device is made from a metal or a metal alloy, e.g. brass or steel, and is sufficiently strong to resist deformation when under load as when a door is opened or closed. Other materials may be suitable as well, for example, thermoplastics, thermosets, wood or ceramics. In some cases, the material may be transparent or translucent, for example LEXAN® plastic or LUCITE® plastic.

The device may be colored, or may be paintable so that the user can customize the appearance of the device.

OTHER EMBODIMENTS

A number of embodiments have been described. Nevertheless, it will be understood that various modifications may be made without departing from the spirit and scope of the disclosure.

For example, rather than extending from a body that is configured to be mounted over existing pocket door hardware, the members could be integral with the pocket door hardware having a latching mechanism (e.g., extend integrally from the side edges of hardware otherwise resembling that shown in FIG. 1).

Another embodiment may feature the device installed in alternate locations on the door. For example, while it is generally preferred that the device be installed over the existing hardware, the device may be installed in a higher or lower location on the door, e.g., to facilitate use by users of different heights or a user in a wheelchair.

In FIG. 2, the device is depicted as being installed on both sides of the door; however, the user could optionally install the device on only one side.

While it is generally preferred that members 45A and 45B protrude the same distance from the body, they could have different heights if desired. For example, member 45A could be shorter (only high enough to act as a stop).

Either or both of the members could be disposed at an angle other than 90 degrees with respect to the body. For example, member 45A could be generally perpendicular to the body while member 45B could be at an acute angle with respect to the body.

Moreover, either of both of the members could be curved in cross-section, rather than extending straight out from the body.

While preferred embodiments feature a central cut-out section, an alternate embodiment could be configured without a central cut-out section or with a cut-out that is offset from center.

While the device 22 is preferably made of one continuous piece, an alternate embodiment could be constructed from multiple pieces.

An alternate embodiment could feature members that do not extend the full length of the device.

Another embodiment could feature members that are textured to enhance the user interface by increasing friction between the member and the user's finger. This could be accomplished by embossing, engraving, or other means.

While the device as shown features solid members, an alternative embodiment could feature members that are skeletal with portions removed.

The device can be provided in any desired style, e.g., including various ornamental features. As an example, the members could be scroll-shaped rather than simple vertical members, and/or the plate could have any desired shape.

Accordingly, other embodiments are within the scope of the following claims.

What is claimed is:

1. A device comprising:

a pocket door surface pull having a top surface, a central recessed area, and a plurality of mounting fastener holes, and a pocket door surface pull cover comprising:

a plate configured to fit over the pocket door surface pull such that it substantially covers the top surface, the plate having an opening dimensioned to allow access to the central recessed area when the plate is positioned over the pocket door surface pull, and grippable flange members protruding from the plate, wherein the plate includes mounting fastener holes that are positioned to align with the mounting fastener holes of the pocket door surface pull when the opening is aligned with the central recessed area.

2. The device of claim 1, wherein the opening is dimensioned to allow use of a locking mechanism.

3. The device of claim 1, wherein the grippable flange members are generally perpendicular to a plane of the plate.

4. The device of claim 1, wherein the grippable flange members have sufficient surface area to allow a user to apply a force to open or close the door.

5. The device of claim 1, wherein the grippable flange members protrude from a surface of the plate at least 5 mm.

6. The device of claim 1, wherein the grippable flange members are positioned on opposite edges of the plate.

7. The device of claim 1, wherein the mounting fastener holes in the plate are elongated.

8. A method of installing a cover for a pocket door surface pull, the method comprising:

(a) placing, over a pocket door surface pull having a top surface, a central recessed area, and a plurality of mounting fastener holes, a pocket door surface pull cover comprising a plate configured to fit over the pocket door surface pull such that it substantially covers the top surface and grippable flange members protruding from the plate, (b) aligning an opening in the plate with the central recessed area such that the central recessed area is exposed when the plate is positioned over the pocket door surface pull, and (c) inserting fasteners through mounting fastener holes in the plate, which are aligned with the mounting fastener holes of the pocket door surface pull when the opening is aligned with the central recessed area.

9. The method of claim 8 further comprising mounting the plate on a door such that the gripping flange members extend generally parallel to a long axis of the door and one of the gripping flange members is aligned with an edge of the door.

* * * * *